US008662720B2

(12) United States Patent
Cifers

(10) Patent No.: US 8,662,720 B2
(45) Date of Patent: Mar. 4, 2014

(54) FOLD-UP BEACON AND ASSOCIATED POST FOR VEHICLES

(76) Inventor: Luther Cifers, Farmville, VA (US)

( * ) Notice: Subject to any disclaimer, the term of this patent is extended or adjusted under 35 U.S.C. 154(b) by 74 days.

(21) Appl. No.: 13/476,441

(22) Filed: May 21, 2012

(65) Prior Publication Data

US 2012/0293990 A1 Nov. 22, 2012

Related U.S. Application Data

(60) Provisional application No. 61/519,352, filed on May 20, 2011.

(51) Int. Cl.
*F21V 17/00* (2006.01)

(52) U.S. Cl.
USPC ..... 362/450; 362/220; 362/249.07; 362/287; 362/431

(58) Field of Classification Search
USPC ..... 362/157, 162, 217.01, 227, 220, 352, 362/557, 431, 450, 287, 249.07; 248/528, 248/533, 138, 150, 155.4
See application file for complete search history.

(56) References Cited

U.S. PATENT DOCUMENTS

| | | | | |
|---|---|---|---|---|
| 4,086,454 | A * | 4/1978 | Bluhm | 200/60 |
| 5,630,660 | A * | 5/1997 | Chen | 362/183 |
| 7,364,320 | B2 * | 4/2008 | Van Deursen et al. | 362/190 |
| 8,201,979 | B2 * | 6/2012 | Deighton et al. | 362/413 |
| 8,303,143 | B2 * | 11/2012 | Webb | 362/413 |
| 8,523,379 | B2 * | 9/2013 | Shay | 362/157 |

* cited by examiner

*Primary Examiner* — Nimeshkumar Patel
*Assistant Examiner* — Jose M Diaz
(74) *Attorney, Agent, or Firm* — Thedford I Hitaffer; Hitaffer & Hitaffer, PLLC

(57) ABSTRACT

A beacon has an associated post that is supported in relation to a watercraft. The beacon may comprise four major separable elongated members all mutually joined by an elastic cord extending along the longitudinal axis of the beacon. When separated, the four major separable members may fold in the compact configuration, thus enabling compact stowage. The beacon may comprise an internal light source, a flag or pennant, and reflective films to signal presence of the watercraft to others. The flag may be formed as a receptacle for receiving and storing the separable elongated members for stowage.

16 Claims, 9 Drawing Sheets

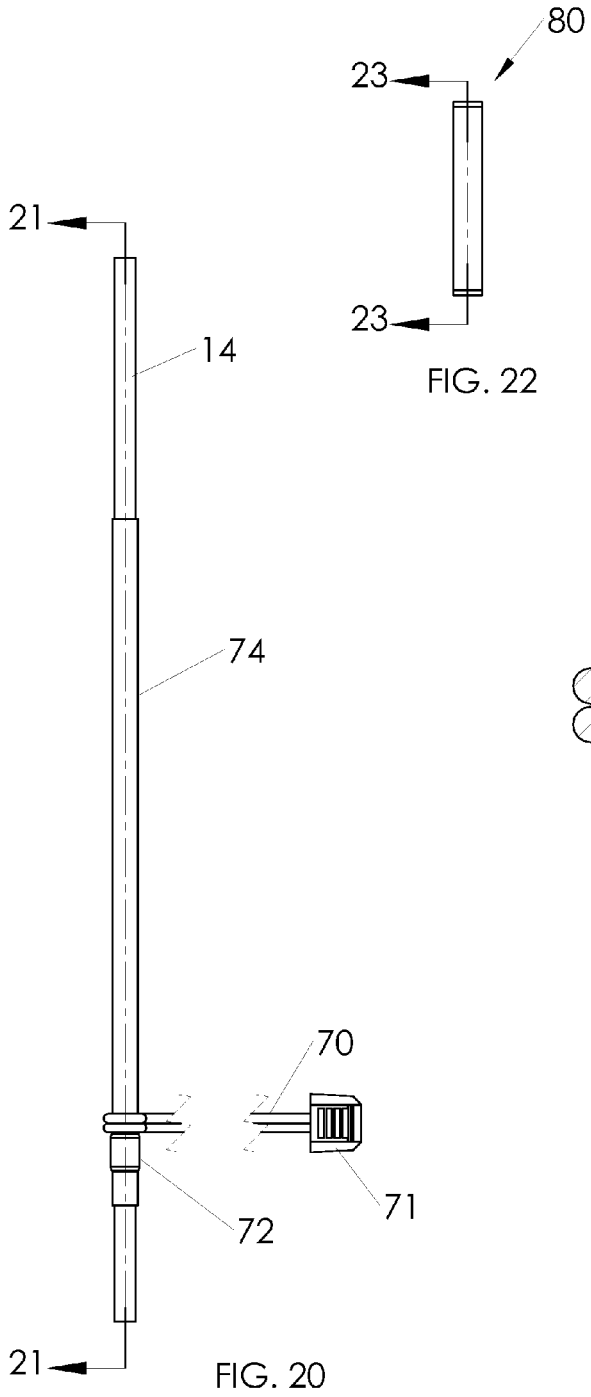
FIG. 20
FIG. 22
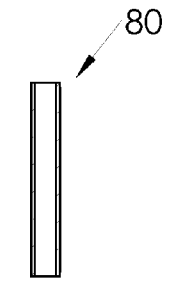
FIG. 23
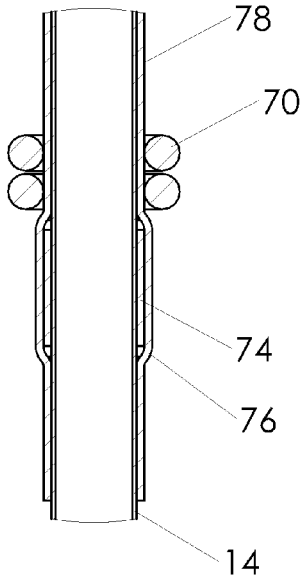
FIG. 25
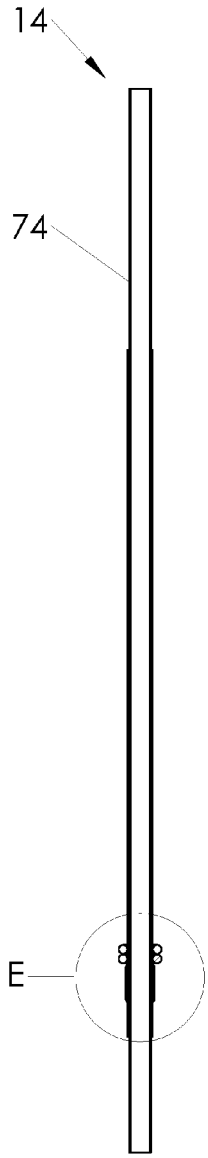
FIG. 21

FOLD-UP BEACON AND ASSOCIATED POST FOR VEHICLES

CROSS-REFERENCE TO RELATED APPLICATIONS

This application claims the benefit of U.S. Provisional Application No. 61/519,352, filed May 20, 2011, the disclosure of which is incorporated herein by reference.

BACKGROUND OF THE INVENTION

The present invention pertains to accessories for personal vehicles, such as a small watercraft, and more particularly, to a manually installable and removable beacon for a vehicle.

Small personal vehicles, such as canoes and kayaks, are quite popular, and are widely used on many natural bodies of water. However, a small watercraft may entail certain difficulties, such as visibility to others, thereby potentially creating hazards to the user of the watercraft. While marker lights and flags of diverse types have been proposed, there remains a need in the art for a practical beacon for announcing presence of a small vehicle such as a watercraft.

SUMMARY OF THE INVENTION

The present invention related to a beacon usable with watercraft and other vehicles, such as bicycles, and small wagons and trailers. The beacon is in the form of a foldable post, which may bear a lamp or a flag or both. The post may be conveniently inserted into an opening or socket, support, or cooperate with a track, which may be formed in a watercraft for receiving and supporting a pole. The post may comprise four relatively rigid members which may be disposed in series to assume the deployed condition of the post, and which may fold into four sections. The several rigid members may be united by an elastic cord extending through the members.

Various advantages of this invention will become apparent to those skilled in the art from the following detailed description of the preferred embodiment, when read in light of the accompanying drawings.

BRIEF DESCRIPTION OF THE DRAWINGS

Similar reference characters denote corresponding features consistently throughout the attached drawings.

FIG. 20 is an elevational view of components seen at the center of the beacon in FIG. 2.

FIG. 21 is a cross sectional view taken along the line 21-21 in FIG. 20.

FIG. 22 is a side elevational view of a component of the beacon seen at the center in FIG. 2.

FIG. 23 is a cross sectional view taken along the line 23-23 in FIG. 22.

FIG. 25 is an enlarged detail view of detail E of the component in FIG. 21.

DETAILED DESCRIPTION OF THE PREFERRED EMBODIMENT

Figure 1:
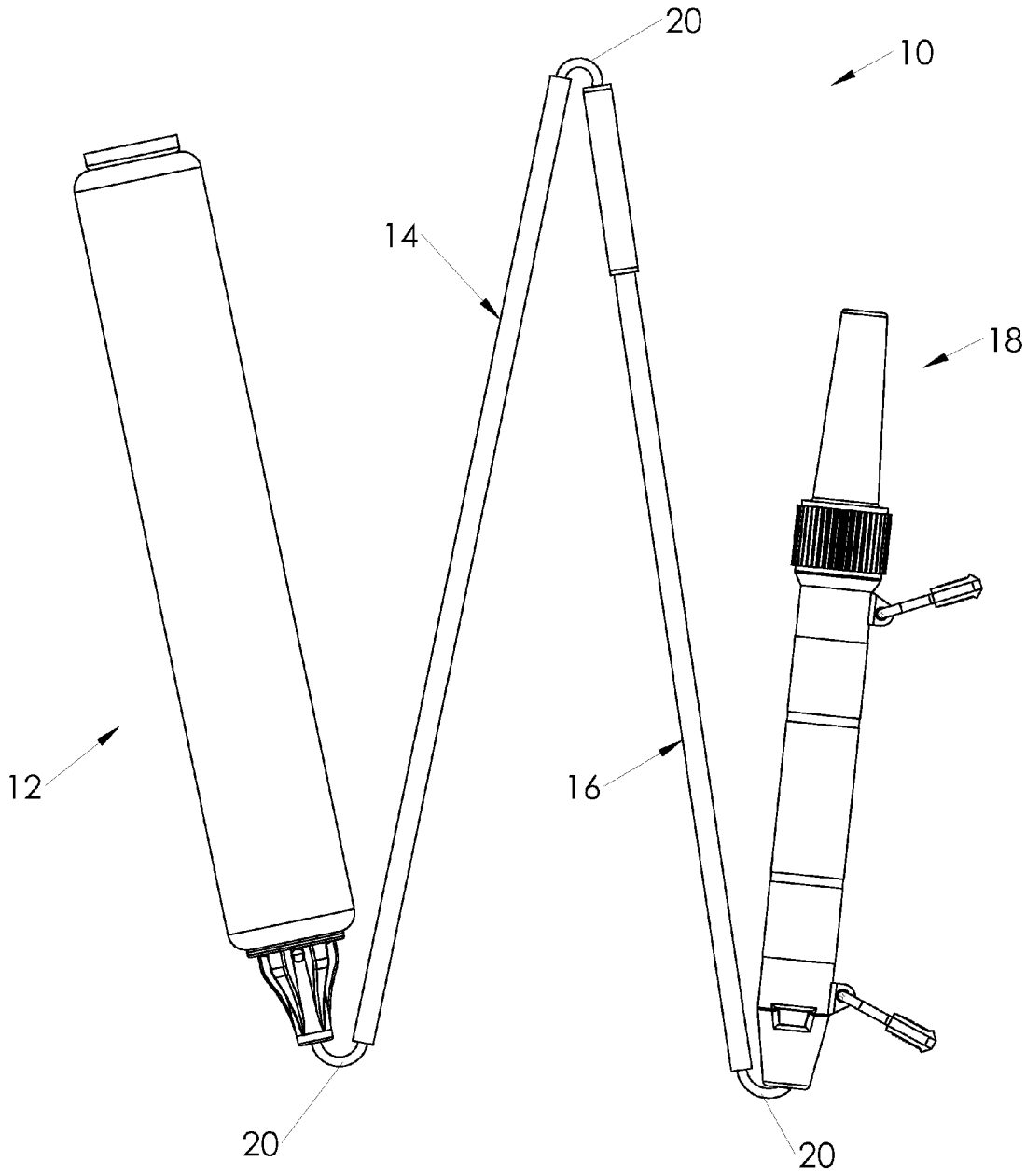
FIG. 1 is a plan view of a beacon in the form of a fold-up light and flag post, showing how the post may be folded for stowage.

Referring now to the drawings, there is illustrated in FIG. 1 a beacon in the form of a fold-up light and flag post 10 in what may be considered a nearly stowed condition. It will be seen that there are four relatively rigid, separable and mutually foldable members including a base 12, at least one intermediate separable member, such as a lower mast tube 14 and an upper mast tube 16, and a beacon support 18, which may be folded to a W-configuration and further folded until completely collapsed upon itself.

In the assembled or deployed condition (see FIG. 2), the separable members 12, 14, 16, 18 are generally aligned in series or head-to-tail orientation along a common longitudinal axis 44 (see FIG. 7) to form a linear array for deployment. An elastic cord 20 (see FIGS. 9 and 10) may be seen emerging from each of the separable members 12, 14, 16, 18 at their respective ends. The elastic cord passes through the hollow center of the intermediate separable members 14, 16 and anchors at each end to the separable members 12, 18. The elastic cord 20 is disposed to exert tensile forces urging the base member 12, the beacon 18, and the intermediate members 14, 16 to maintain the linear array, thereby establishing the deployed condition.

Figure 2:
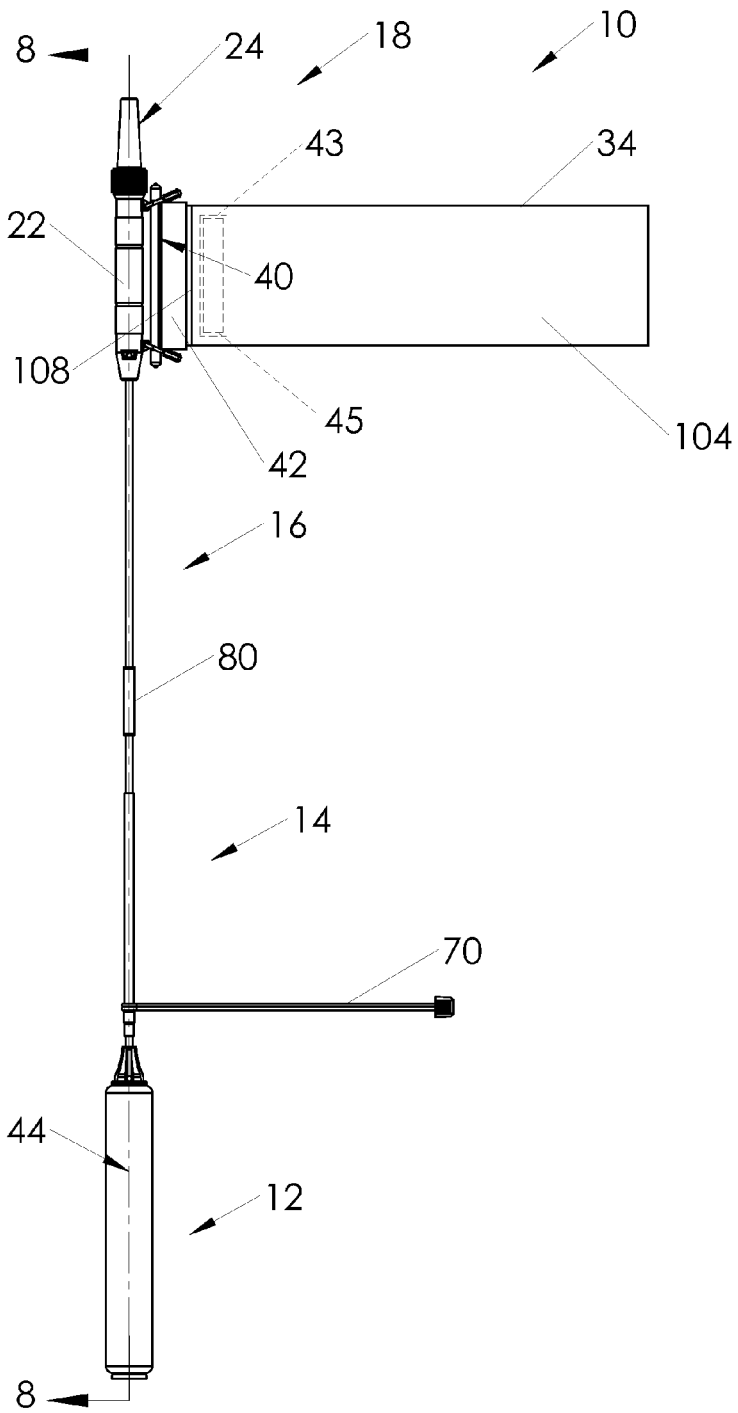
FIG. 2 is an elevational view of the beacon in FIG. 1.

The elastic cord 20 is anchored at each of the end members including the base 12 and the beacon support 18 to keep the separable members united regardless of whether the separable members are axially aligned in the deployed position as seen in FIG. 2 or the fold-up light and flag post 10 is folded as seen in FIG. 1.

It should be understood that orientational terms, such as upper and lower, are employed herein only for semantic purposes. The drawings, such as FIG. 2, show the subject matter in ordinarily encountered positions of use, that is, with the beacon support 18 at the uppermost location on the fold-up light and flag post 10, so that orientational terms will refer to the conventional position of use. Obviously, the fold-up light and flag post 10 may be held in any position.

Figure 3:
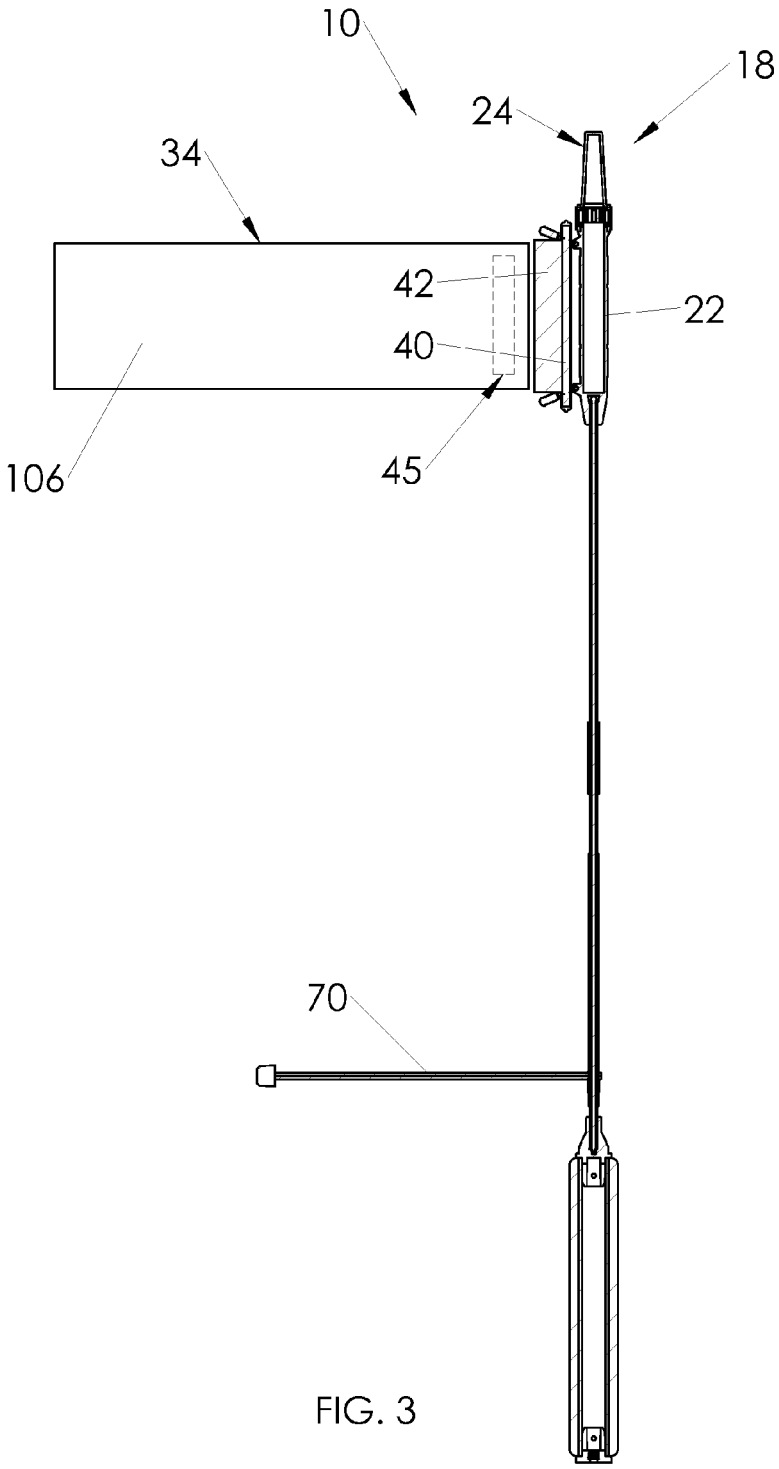
FIG. 3 is a cross sectional view of the beacon taken along the line 3-3 in FIG. 7.

FIGS. 2 and 3 show the fold-up light and flag post 10 in the deployed position, wherein the base 12, the lower mast tube 14, the upper mast tube 16, and the beacon support 18 are aligned in series with a light body 22 of the beacon support 18, which may terminate in a diffuser 24, pointing upwardly. The diffuser 24 may be disposed to direct light generated within the beacon support 18 laterally about three hundred sixty degrees. The base 12, the lower mast tube 14, the upper mast tube 16, and the beacon support 18 may interfit by friction, such as by telescoping, so that the fold-up light and flag post 10 may be assembled and disassembled by hand. The upper mast tube may be formed from carbon fiber or other materials having similar rigidity. The light body 22 may enclose a light source, such as an LED module 26 (see FIG. 4), and may further comprise a flag 34, which may be held to the light body 22 by attachment hardware (see FIG. 4) and external reflective elements (see FIG. 4). The LED module 26 may include a plurality of light emitting diodes (LEDs), a circuit board disposed to conduct electrical power to each LED, a power source, such as a battery, and a switch (these components of the LED module 26 are not separately shown). LED modules, such as the LED module 26, are available as commercial products and need not be further detailed herein.

Figure 4:
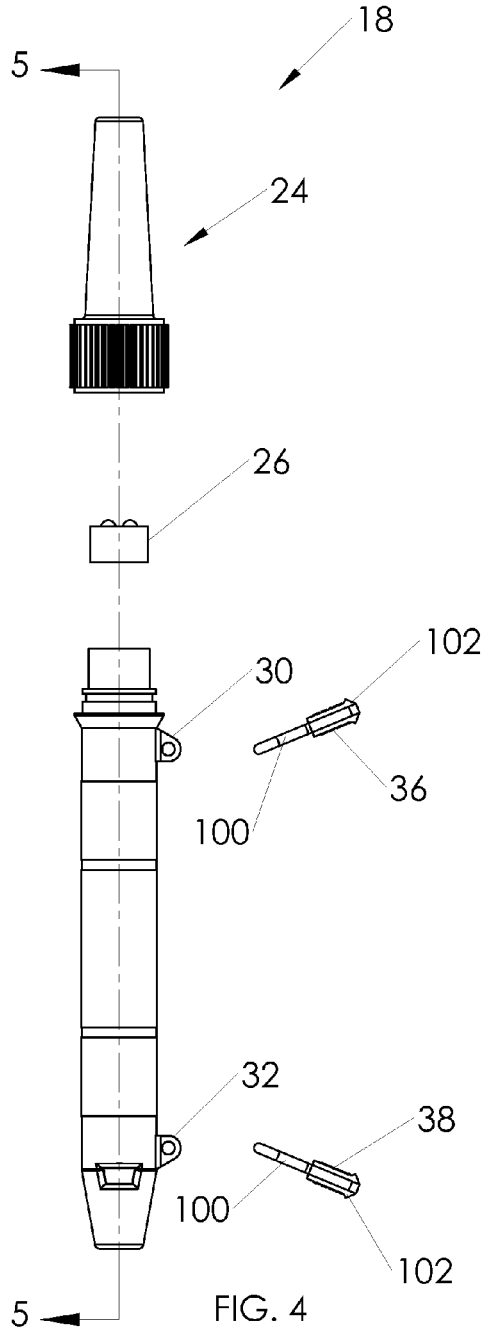
FIG. 4 is an exploded elevational detail view of the top of part the beacon in FIG. 2.

FIG. 4 shows lugs 30, 32, which may be employed to secure the flag 34 to the beacon support 18. Flag retainers 36, 38, which may be in the form of an elastic loop (formed by an elastic cord 100 and connector clip 102), which may be anchored at the lugs 30, 32, and may, in turn, connect to or support upper and lower ends of an attachment tube 40. The flag may comprise two layers 104, 106 of fabric material joined along three edged to form a receptacle with an opening 108 for storage of the beacon when not in use. An inner surface of one layer of the flag may support a patch 43 carrying a hook and loop fastener portion, which releasably mates with a patch 45 on the inner surface of another layer of the flag carrying a hook and loop fastener portion, so that both patches are located on the interior of the flag 34. The patch 43 removably fastens to the patch 45 to close a receptacle formed by two layers of the flag 34. The flag may also comprise a header flap 42 projecting from its parallelepiped form. The header flap 42 enables securement of the flag 34 to the beacon 18, which is accomplished by entrapping the attachment tube 40 inside the header flap 42 by encircling the tube 40 and engaging itself prior to fastening the tube 40 to the beacon. The attachment tube 40 may be coupled to the beacon 18 in a spaced apart, generally parallel relation thereto, as shown, to enable the flag 34 to project perpendicularly from the longitudinal axis 44 when mounted to the beacon 18.

Figure 6:
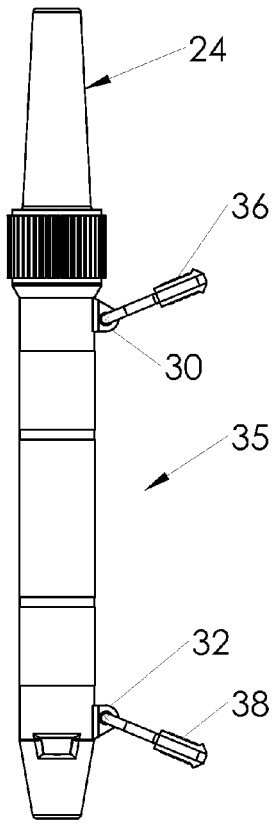
FIG. 6 is an enlarged elevational view of the part in FIG. 4.
Figure 5:
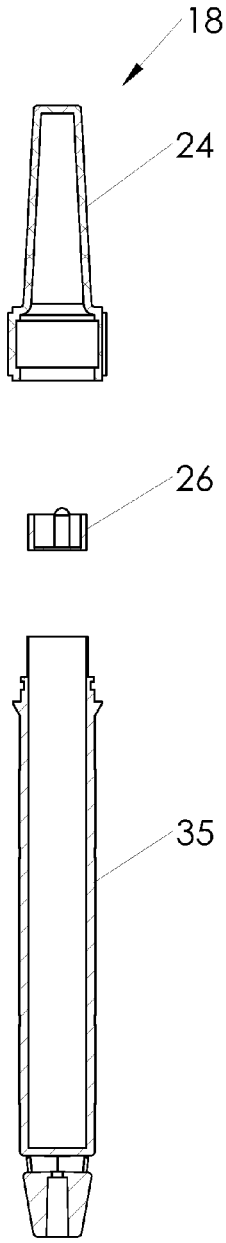
FIG. 5 is a cross sectional view of part in FIG. 4 taken along the line 5-5.

FIG. 5 shows the components of FIG. 4 in cross section, wherein it is seen that the main body 35 of the beacon support 18 may be generally tubular and hollow. An intermediate stage of assembly wherein the flag retainers 36, 38 engage the lugs 30, 32 is shown in FIG. 6.

Figure 8:
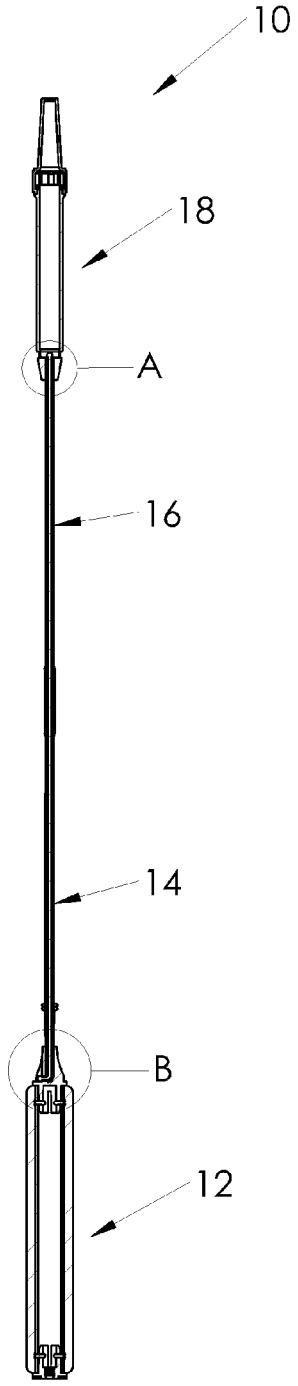
FIG. 8 is a cross section of the beacon taken along the line 8-8 in FIG. 2.
Figure 7:
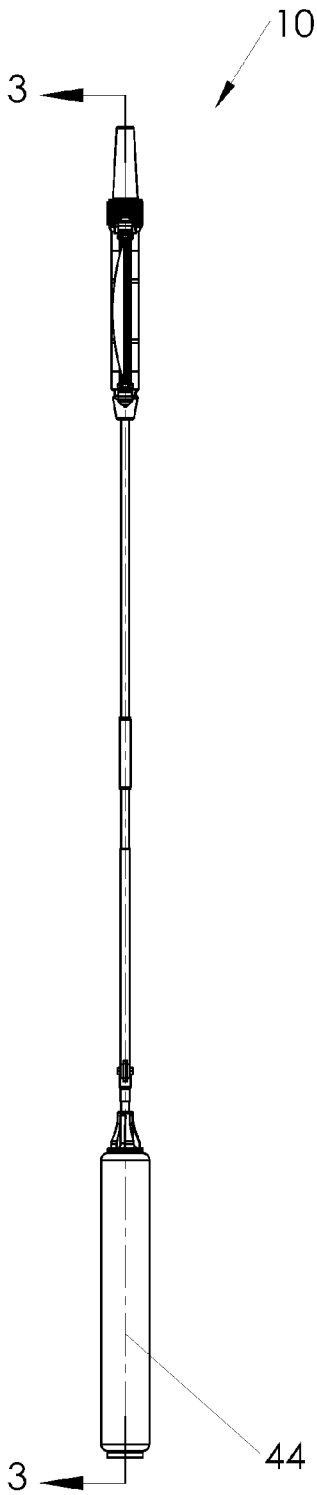
FIG. 7 is similar to FIG. 2, but shows the beacon rotated by ninety degrees.
Figure 9:
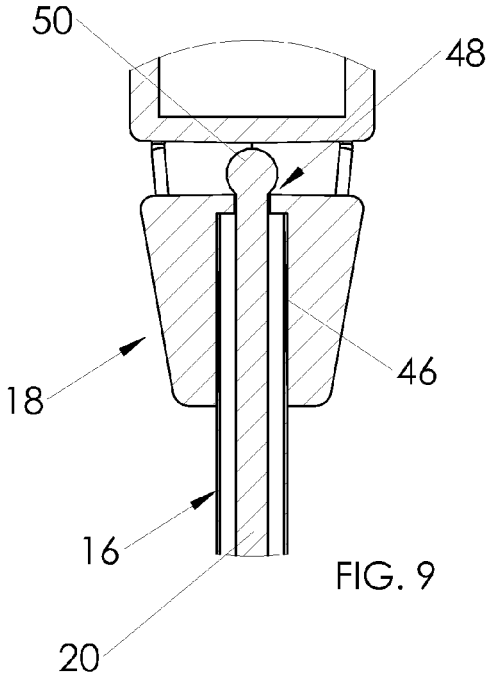
FIG. 9 is an enlarged cross sectional detail view of components in detail A near the top of the beacon in FIG. 8.
Figure 10:
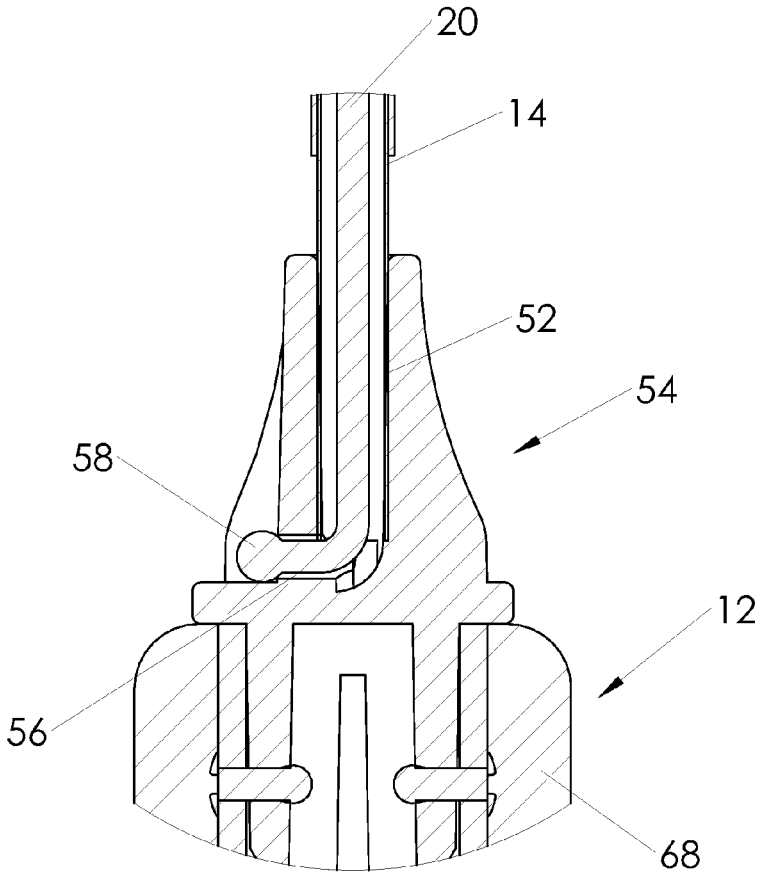
FIG. 10 is an enlarged cross sectional detail view of components in detail B near the bottom of the beacon in FIG. 8.

FIG. 7 shows the fold-up light and flag beacon 10 of FIG. 2, but rotated about its longitudinal axis 44 by ninety degrees. FIG. 8 shows the subject matter of FIG. 2 in cross section, and also calls out details A, B shown in FIGS. 9 and 10. FIG. 9 shows how the beacon support 18 engages the upper mast tube 16. The lower end of the beacon support 18 terminates in a socket 46 into which the upper mast tube 16 may be inserted. The elastic cord 20 passes through the hollow center of the upper mast tube 16, passes through a constriction 48 formed in the socket 46, and terminates in a knot 50, thereby being entrapped by interference fit at the lower end of the beacon support 18. The elastic cord 20 extends downwardly from the upper mast tube 16 through the lower mast tube 14 and into the base 12. As seen in FIG. 10, the elastic cord 20 emerges from the end of the lower mast tube 14 and is received within a passage 52 formed in a mast adapter 54 of the base 12. The elastic cord 20 emerges through an opening 56 and terminates at a knot 58, and is thereby entrapped by interference fit at the mast adapter 54 of the base 12. Although reference is made to knots 50 and 58, it is not necessary to actually use knots. It would be sufficient to employ any means to enlarge the effective diameter of the elastic cord 20 at the points represented by the knots 50, 58. For example, metallic collars (not shown) could be crimped over the ends of the elastic cord 20 at the location of the knots 50, 58 instead of using knots. Alternatively, the ends of the elastic cord 20 could be potted in a hardenable substance (not shown) to the same effect. Several of these options may be utilized simultaneously, for example, to prevent unraveling of the knots where knots are used.

Figure 11:
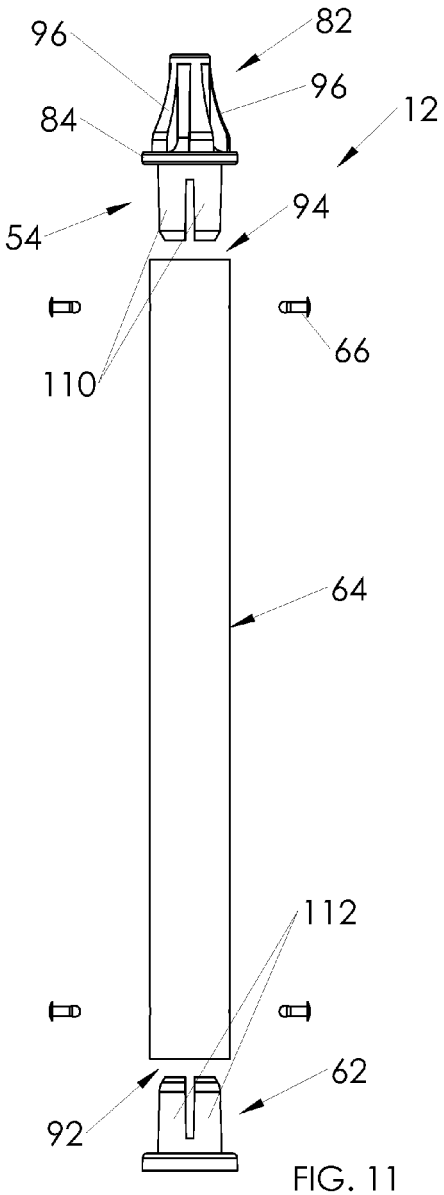
FIG. 11 is an exploded elevational view of a component seen at the bottom of the beacon in FIG. 2.

Referring particularly to FIG. 11, the base 12 may be assembled by inserting a mast adapter 54 and a mount adapter 62 into opposing ends of a tube 64. Rivets 66 (only one of four identical rivets shown is called out by reference numeral) may be installed to secure the installation of the base 12. The mast adapter 54 and the mount adapter 62 each may have respective legs 110, 112 for frictionally engaging the interior surface (not visible in FIG. 11) of the tube 64.

The mast adapter 54 is seen to comprise an upwardly projecting protrusion 82 and the downwardly projecting legs 110. Ribs 96, which are perpendicular to the longitudinal axis 44, assist in opposing bending of a mast tube, such as the mast tube 14 at the base 12. The upwardly projecting protrusion 82 and legs 110 are on opposed sides of a flange 84. The mast adapter 54 may comprise a deep socket 73 (see FIG. 18) for receiving a mast tube, such as the mast tube 14, which may receive the intermediate member 14 in close cooperation therewith. The deep socket 73 may have a floor or shoulder 75 (see FIG. 19) serving as a stop for limiting the degree to which a mast tube may penetrate the mast adapter 54.

Figure 24:
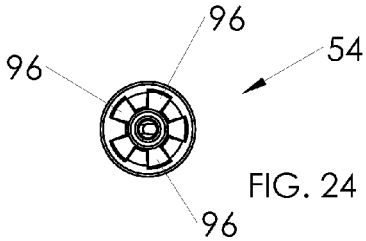
FIG. 24 is a top plan view of the component in FIG. 11.
Figure 13:
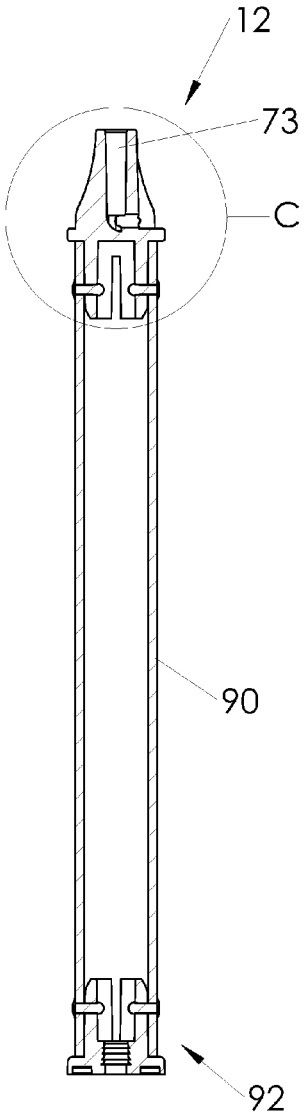
FIG. 13 is a cross sectional view taken along the line 13-13 in FIG. 12.

Referring to FIGS. 11 and 13, the base member 12 may comprise a generally tubular body having an open proximal end 92 and an open distal end 94. The mount adapter 62 may serve as a lower cap closing the generally tubular body 64 at the proximal end 92. The mast adapter 54 may serve as an upper cap closing the generally tubular body 64 at the distal end 94. The mast adapter 54 may comprise radially projecting ribs 96 (seen in plan view in FIG. 24), which are parallel to the longitudinal axis 44, which ribs 96 may oppose bending of the base member 12 at the socket 73.

Figure 16:
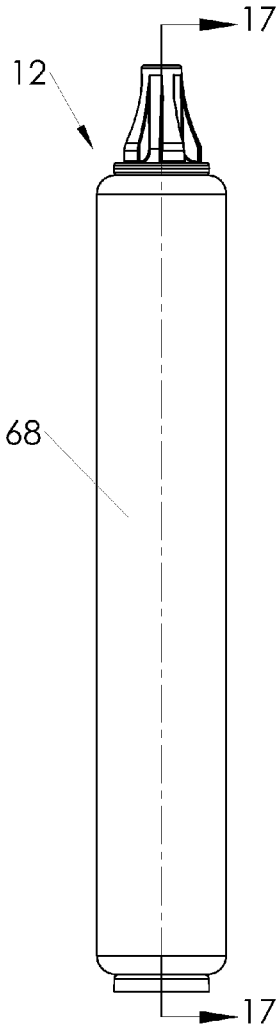
FIG. 16 is an elevational view of FIG. 14, further illustrating an external sleeve covering the components in FIG. 14.
Figure 17:
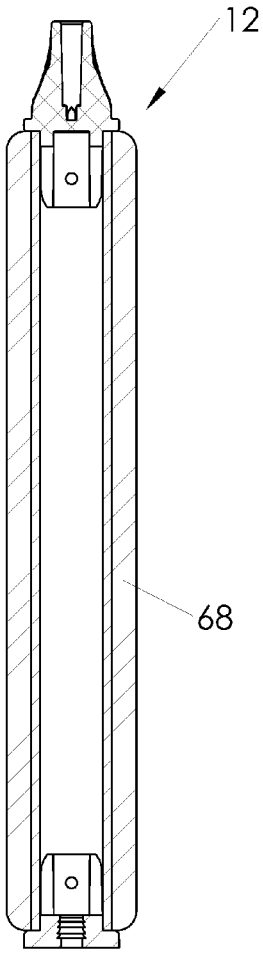
FIG. 17 is a cross sectional view taken along the line 17-17 in FIG. 16.
Figure 12:
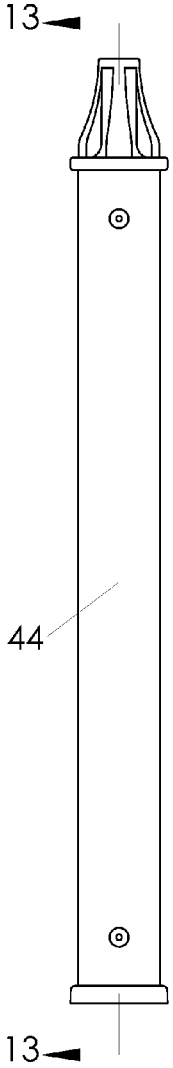
FIG. 12 is an elevational view showing the components in FIG. 11 assembled.
Figure 14:
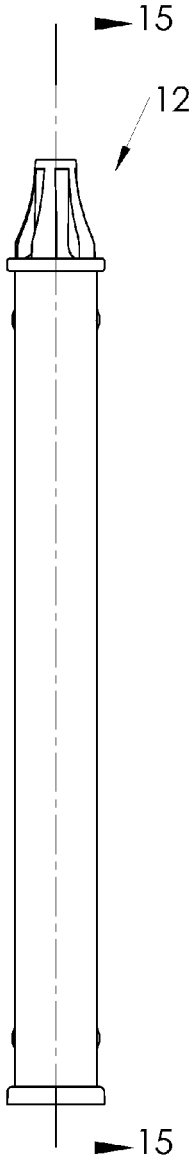
FIG. 14 is an elevational view of the components in FIG. 12 rotated about the longitudinal axis.
Figure 15:
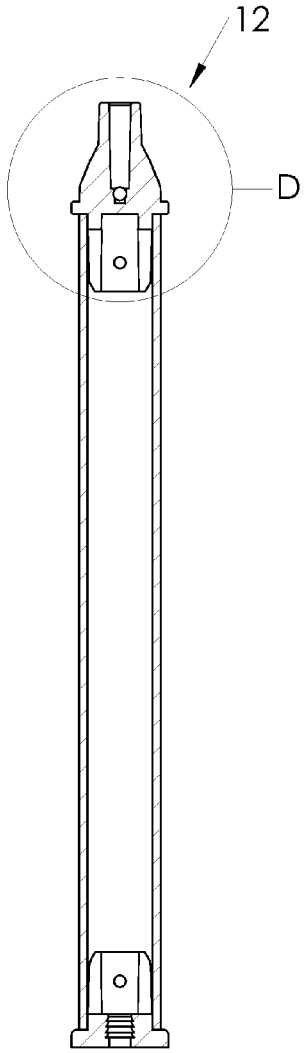
FIG. 15 is a cross sectional view taken along the line 15-15 in FIG. 14.

FIG. 12 shows the base 12 after assembly and installation of the rivets 66. FIG. 13 shows the assembled base 12 in cross section taken along the line 13-13 in FIG. 12. FIG. 14 shows the base 12 rotated about its longitudinal axis 44 from the position seen in FIG. 12. FIG. 15 shows the base 12 after assembly and in cross section taken along the line 15-15 in FIG. 14. FIG. 16 shows a cover sleeve 68, which has been placed over the base 12. The cover sleeve 68 may be fabricated from a closed cell foam, so that the cover sleeve 68 is both resilient and also provides a close fit which may restrict excess movement when the base 12 is inserted into a rod holder or the like (not shown) of a watercraft. Also, a closed cell foam would promote buoyancy, so that the fold-up light and flag post 10 would tend to float if dropped into the water. FIG. 17 shows the base 12 with the cover sleeve 68 in cross section.

Although the beacon may be inserted into an opening or socket associated with the watercraft, it may also be threaded to receive a tee bolt, which may cooperate with a groove in a track, which may be formed in the watercraft. Other configurations of the mount adapter 62 may be used to interface with a variety of commercially available mounts.

Figure 18:
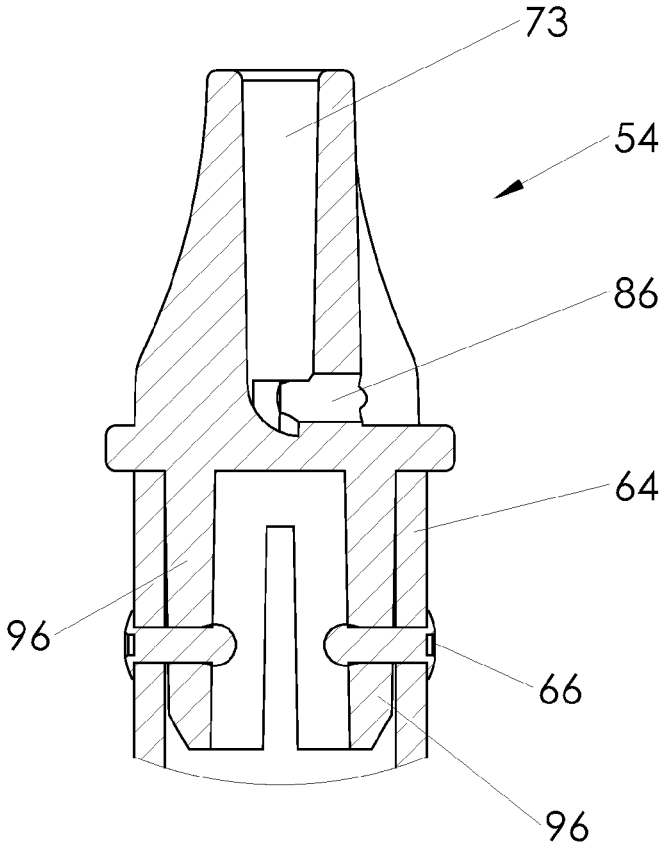
FIG. 18 is an enlarged cross sectional detail view of the top in detail C in FIG. 13.
Figure 19:
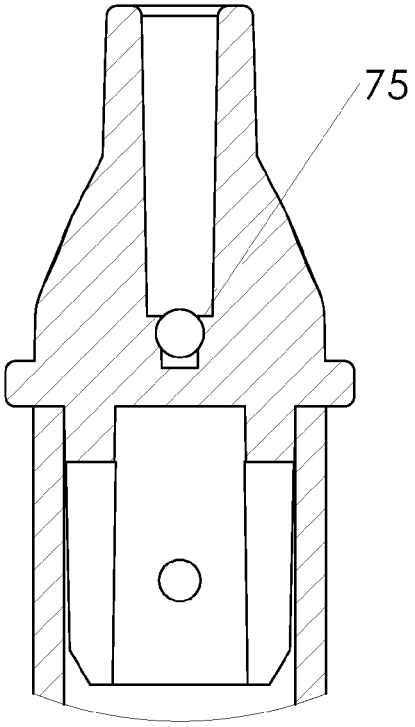
FIG. 19 is an enlarged cross sectional detail view of the top in detail D in FIG. 15.

FIG. 18 shows internal details of the top of the base 12 after assembly. The mast adapter 54 is shown riveted to the tube 64. FIG. 19 shows the mast adapter 54 and the tube 64 rotated by ninety degrees about the longitudinal axis 44 (see FIG. 12) of the base 12. An entry hole 86 for the elastic cord 20 may be perpendicular to the longitudinal axis 44.

Riveting of the mast adapter 54 is made more effective due to construction thereof. The mast adapter 54 may comprise at least one leg 112 that projects into the generally tubular body 64 in close cooperation therewith, which enables the mount adapter 54 to engage the tubular body 64 by friction fit. Each one of a plurality of rivets, such as the rivet 66, which when coupling the mast adapter 54 to the generally tubular body 64, engages the legs 112 and draws the legs 112 into tighter abutment with the generally tubular body 64 when the rivet is installed and expanded.

FIG. 20 shows the lower mast tube 14 engaged by a flexible lanyard 70, with components seen in greater scale in FIG. 25. The lanyard 70 may terminate in a connector clip 71 to enable the lanyard 70 to form a closed loop. The lanyard 70 enables the fold-up light and flag post 10 to be tethered in a folded configuration by wrapping the lanyard around the folded post 10 and encircling the end of the lanyard around the beacon support 18. A lanyard stop 72 may prevent the lanyard 70 from descending inadvertently or spontaneously along the lower mast tube 14. The lanyard stop 72 may comprise a sleeve 74 disposed within a bulging portion 76 of a lanyard grip 78, which encircles the lower mast tube 14. The sleeve 74 may be built up from several windings of an adhesive backed reflective vinyl film. As employed herein, "reflective" signifies a material which is purposefully chosen or intended to reflect impinging light, as opposed to the inherent characteristic that visible objects necessarily reflect light. The lanyard grip 78 may be formed from heat shrink tubing.

FIG. 21 is a cross section of the lower mast tube 14 taken from line 21-21 in FIG. 20.

The lower mast tube 14 may be utilized with the upper mast tube 16, as depicted, or if greater overall length of the fold-up light and flag post 10 is desired, with additional mast tubes (not shown). Each mast tube, such as the mast tube 14, may be formed to fit telescopically or by frictional interfit to the next mast tube by fixing a ferrule 80 thereover at the end, thereby effectively increasing the interior diameter of the mast tube. This enables additional mast tubes to be connected serially by insertion into the ferrule of an adjacent mast tube. FIGS. 22 and 23 illustrate a representative ferrule 80. The ferrule 80 may be covered by a reflective film, so that the fold-up light and flag post 10 may visually present three forms of beacons, namely, the light from the LED module 26, the flag 34, and reflective films.

Referring again to FIG. 4, the main body 35 (see FIG. 6) of the beacon support 18 may generally comprise a plastic tube having external rings, which may serve as guides for installing reflective films or bands.

As mentioned above, the flag 34 may be of two ply construction, stitched along three of four sides to form a receptacle. The remaining side may form an opening 108 and bear hook and loop fasteners for closing the opening. The receptacle thus formed by the flag 34 may serve as a storage bag for the fold-up light and flag post 10 when the latter is stowed. This may be accomplished with the major components of the fold-up light and flag post 10 in the W-folded configuration seen in FIG. 1, or alternatively stated, with the major separable members of the fold-up light and flag post 10 disposed abreast of one another.

It will be appreciated that the elastic cord will be sufficiently tight so as to urge the major separable members against one another in the deployed position seen in FIG. 2. This degree of force can be easily overcome to fold the fold-up light and flag post 10 for stowage as seen in FIG. 1. However, the elastic cord 20 is sufficiently long as to enable the base member 12, the beacon 18, and intermediate members 14, 16 to be withdrawn or separated from the linear array of the deployed condition, and to fold such that the base member 12, the beacon 18, and the intermediate members 14, 16 are abreast of one another, thereby assuming a folded condition for stowage. A minimal amount of manual effort may be required to align the major separable members in series for deployment. However, once the major separable members are aligned, tensile force of the elastic cord 20 will tend to hold them together.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A fold-up illuminated beacon post, comprising:
an elongated base member;
a beacon comprising a light source;
at least one elongated intermediate member disposed between the base member and the beacon; and
an elastic cord extending from the base member through the intermediate member to the beacon, wherein
the base member, the beacon, and the intermediate member each interfit to one another in series along a common longitudinal axis to form a linear array,
the elastic cord is disposed to exert tensile forces urging the base member, the beacon, and the intermediate member to maintain the linear array, thereby establishing a deployed condition, and
the elastic cord is sufficiently long as to enable the base member, the beacon, and the intermediate member to be withdrawn from the linear array and to fold such that the base member, the beacon, and the intermediate member are abreast of one another, thereby assuming a folded condition for stowage.

2. The fold-up beacon post of claim 1, wherein the beacon further comprises a flag projecting therefrom.

3. The fold-up beacon post of claim 2, wherein
the flag forms a receptacle of dimensions sufficiently to receive therein the base member, the beacon, and the intermediate member when the base member, the beacon, and the intermediate member are in the folded condition, the flag comprising a hook and loop fastener located on the interior of the receptacle.

4. The fold-up beacon post of claim 1, further comprising an attachment tube coupled to the beacon in spaced apart, generally parallel relation thereto, wherein the flag comprises a header flap that is disposed to encircle and engage the attachment tube so that the flag is supported in relation to the beacon when the tube is coupled to the beacon.

5. The fold-up beacon post of claim 1, wherein the elastic cord is held to the beacon by interference fit therewith, and extends inside and along the intermediate member.

6. The fold-up beacon post of claim 1, wherein the elastic cord is held to the base member by interference fit therewith.

7. The fold-up beacon post of claim 1, wherein the base member comprises a generally tubular body having an open proximal end and an open distal end, a lower cap closing the generally tubular body at the proximal end, and an upper cap closing the generally tubular body at the distal end, and wherein the upper cap further defines a socket therein, which is disposed to receive the intermediate member in close cooperation therewith.

8. The fold-up beacon post of claim 7, wherein the upper cap comprises radially projecting ribs which are parallel to the longitudinal axis, thereby opposing bending of the base member at the socket.

9. The fold-up beacon post of claim 7, wherein the upper cap comprises at least one leg projecting into the generally tubular body in close cooperation therewith, the beacon comprises a plurality of rivets for coupling the upper cap to the generally tubular body, and at least one rivet engages a said leg and draws the leg into tighter abutment with the generally tubular body when the rivet when installed and expanded.

10. The fold-up beacon post of claim 1, wherein the beacon comprises an elongated body having a proximal end and a distal end, and a socket disposed to receive the intermediate member in close cooperation therewith formed at the proximal end.

11. The fold-up beacon post of claim 10, wherein the elongated body of the beacon is hollow and contains a light source therein, and further comprises a diffuser disposed to diffuse light emitted by the light source throughout a range of three hundred sixty degrees relative to the longitudinal axis.

12. The fold-up beacon post of claim 10, further comprising reflective material disposed on the exterior of the elongated body of the beacon.

13. The fold-up beacon post of claim 1, further comprising reflective material disposed on the exterior of the intermediate member.

14. The fold-up beacon post of claim 1, further comprising a flexible lanyard coupled thereto, for tethering the fold-up beacon post in a folded condition.

15. The fold-up beacon post of claim 1, wherein the base member further comprises a sleeve formed from a resilient closed cell foam.

16. The fold-up beacon post of claim 1, wherein there are two said intermediate members which fit to one another telescopically in a friction fit, and the elastic cord passes through both of the two said intermediate members.

* * * * *